United States Patent [19]

Hansson

[11] Patent Number: 4,761,151

[45] Date of Patent: Aug. 2, 1988

[54] HYDRAULIC TORQUE IMPULSE GENERATOR

[75] Inventor: Gunnar C. Hansson, Stockholm, Sweden

[73] Assignee: Atlas Copco Aktiebolag, Nacka, Sweden

[21] Appl. No.: 75,120

[22] Filed: Jul. 20, 1987

[30] Foreign Application Priority Data

Jul. 24, 1986 [SE] Sweden ..... 8603198

[51] Int. Cl.[4] ..... B25D 15/00

[52] U.S. Cl. ..... 464/25

[58] Field of Search ..... 173/93, 93.5; 464/24, 464/25

[56] References Cited

U.S. PATENT DOCUMENTS 3,263,449 8/1966 Kramer ..... 464/25

4,553,948 11/1985 Tatsuno ..... 464/25

*Primary Examiner*—Daniel P. Stodola

*Attorney, Agent, or Firm*—Frishauf, Holtz, Goodman & Woodward

[57] ABSTRACT

A hydraulic torque impulse generator comprising a drive member (10) drivingly connected to a rotation motor and formed with a fluid chamber (11), and an output spindle (12) extending into the fluid chamber (11). Two radially movable seal elements (14, 15) of cylindrical shape are supported in a through slot (13) in the output spindle (12) and are arranged to sealingly cooperate with two axially extending ridges (17, 18) in the fluid chamber (11). A first set of two diametrically opposed and helically extending seal ribs (19, 20) on the drive member (10) is arranged to sealingly cooperate with a second set of two diametrically opposed and helically extending seal ribs (21, 22) on the output spindle (12). The pitch of one of the ribs (19) on the drive member (10) is equal to the pitch of one of the ribs (21) on the output spindle (12), whereas the other of the ribs (20) on the drive member (10) has a pitch that is equal to the pitch of the other rib (22) on the output spindle (12) but different to the pitch of the first mentioned ribs (19, 21). Thereby, a sealing cooperation of the seal ribs (19–22) occurs just once per relative revolution between the drive member (10) and the output spindle (12).

4 Claims, 1 Drawing Sheet

HYDRAULIC TORQUE IMPULSE GENERATOR

BACKGROUND OF THE INVENTION

This invention relates to a hydraulic torque impulse generator, primarily but not exlusively intended for screw joint tightening applications, such as power wrenches.

In particular, the invention concerns a hydraulic torque impulse generator comprising a drive member coupled to a rotation motor, a fluid chamber in said drive member, and an output spindle extending into said fluid chamber, and seal means associated with said drive member and said output spindle and arranged to sealingly divide during certain repeated intervals of the relative rotation of said drive member and said output spindle said fluid chamber into at least two high pressure compartments and at least two low pressure compartments.

An impulse generator of the above type is previously described in U.S. Pat. No. 4,553,948. In this known device the seal means comprises two sets of axially extending seal ribs which are asymmetrically disposed in relation to a diameter line in order to obtain a sealing cooperation between the seal ribs just once every relative revolution between the drive member and the output spindle.

The specific seal rib arrangement of this known device is disadvantageous in that the bypass flow across the seal ribs during the non-sealing sequences is restricted to some extent, which means a slower acceleration of the drive member and a lower impulse energy output.

The above problem is solved by the torque impulse generator according to the invention.

A preferred embodiment of the invention is hereinbelow described in detail with reference to the accompanying drawing.

DETAILED DESCRIPTION

Figure 1:
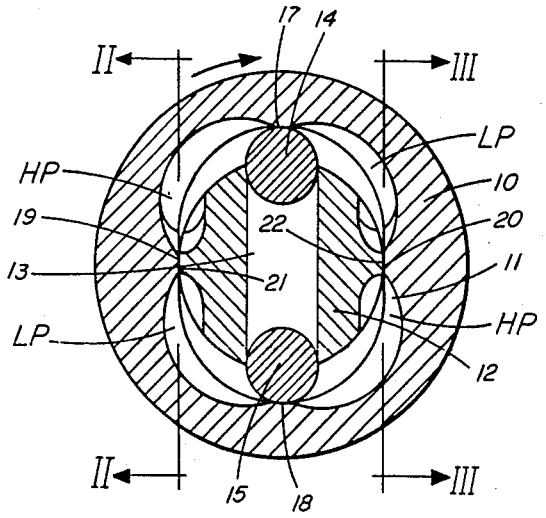
FIG. 1 shows a cross section through an impulse generator according to the invention.

In the drawing FIG. 10 designates a drive member which is drivingly coupled to a rotation motor (not illustrated). The drive member 10 is formed with a cylindrical fluid chamber 11 which contains hydraulic fluid and into which the rear end portion of an output spindle 12 extends. The latter is formed with a transverse through slot 13 in which two cylindrical seal elements 14, 15 are radially movable for sealing contact with longitudinal ridges 17, 18 on the fluid chamber wall.

Figure 2:
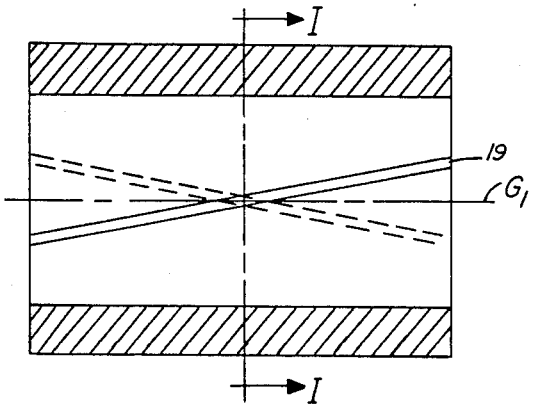
FIG. 2 shows a logitudinal section along line II—II in FIG. 1.
Figure 3:
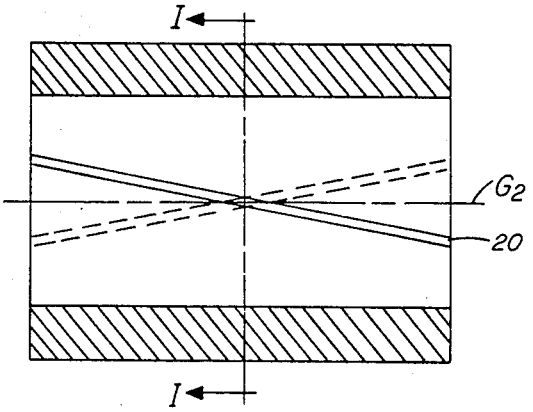
FIG. 3 shows a longitudinal section along line III—III in FIG. 1.

At diametrically opposite positions 90 degrees angularly spaced from the ridges 17, 18, the fluid chamber 11 is formed with a set of two helically extending seal ribs 19, 20. As appears from FIGS. 2 and 3 these ribs 19, 20 have different pitches in relation to generatrices $G_1$ and $G_2$ to the cylindrical chamber 11. The pitches are differently directed such that seal rib 19 has a right hand directed pitch, whereas the rib 20 has a left hand directed pitch. The pitches of both ribs are constant though.

Similarly, the output spindle 12 is provided with a set of two diametrically opposite seal ribs 21, 22 which extend helically along the output spindle 12 at different pitches. Rib 21 has a right hand directed pitch of the same angle as the pitch of seal rib 19 in the fluid chamber 11, whereas rib 22 has a pitch of the same direction and size as the pitch of seal rib 20 in the fluid chamber 11.

In operation, the drive member 10 is rotated in the direction of the arrow in FIG. 1 which brings the seal means of the output spindle 12 and the drive member 10 into sealing engagements once every relative revolution between the drive member 10 and the output spindle 12. In this seal position, shown in FIG. 1, the fluid chamber 11 is divided into two high pressure compartments H.P. and two low pressure compartments L.P. The difference in pressure between these compartments generates a torque impulse in the output spindle 12.

Two high pressure build-ups in the fluid chamber 11 during one and the same revolution are avoided in that the seal ribs 19, 20 on the drive member 10 do not come into alignment with the seal ribs 21, 22 on the drive member 10 as the latter occupies a 180 degrees displaced position. As being illustrated in dash lines in FIGS. 2 and 13, the seal ribs 19, 20 of the drive member 10 will occupy positions in which they cross over their above mentioned seal positions which are the same as the positions of the seal ribs 21, 22 of the output spindle.

After a further 180 degree rotation of the drive member 10 the seal ribs 19, 20 of the latter will again come into alignment with the seal ribs 21, 22 of the output spindle 12, and since at the same time the seal elements 14, 15 sealingly engage the ridges 17, 18, pressure peaks are built up in the high pressure compartments H.P. and a torque impulse is generated in the output spindle 12.

I claim:

1. Hydraulic torque impulse generator, comprising:

a drive member (10) coupled to a rotation motor, said drive member (10) including a fluid chamber (11) located in said drive member (10), said fluid chamber (11) having a substantially cylindrical wall, an ouput spindle (12) extending into said fluid chamber (11), said ouput spindle (12) being relatively rotatable with respect to said drive member (10), and seal means (14–22) associated with said drive member (10) and said output spindle (12) and arranged to sealingly divide during certain repeated intervals of the relative rotation of said drive member (10) and said output spindle (12) said fluid chamber (11) into at least two high pressure compartments (H.P.) and at least two low pressure compartments (L.P.), said seal means (14–22) comprising a first set of at least two helically extending seal ribs (19, 20) located on and extending throughout the axial length of the fluid chamber wall of said drive member (10), and a second set of at least two helically extending seal ribs (21, 22) located on said output spindle (12), said seal ribs (19–22) of each of said first and second sets of seal ribs having different pitches, and each seal rib in one of said first and second sets of seal ribs having a pitch that is substantially equal to the pitch of only one of the seal ribs in the other of said first and second sets of ribs, such that sealing alignment is obtained simultaneously between said seal ribs (19,20) on said fluid chamber wall of said drive member (10) and said seal ribs (21, 22) on said output spindle (12) only once every relative revolution between said drive member (10) and said output spindle (12).

2. Impulse generator according to claim 1, wherein each of said first and second sets of seal ribs comprises two diametrically opposed seal ribs one of which has a right hand directed pitch and the other of which has a left hand directed pitch.

3. Impulse generator according to claim 1, wherein all of said seal ribs (19–22) have substantially constant pitches.

4. Impulse generator according to claim 2, wherein all of said seal ribs (19–22) have substantially constant pitches.

* * * * *